US006955014B2

(12) United States Patent
LeJeune et al.

(10) Patent No.: US 6,955,014 B2
(45) Date of Patent: Oct. 18, 2005

(54) INSULATED CONCRETE CAST PANELS WITH VOIDS IN BILLITS

(75) Inventors: Michael LeJeune, Wayzata, MN (US); Thomas Kuckhahn, Prior Lake, MN (US); Jason Hensley, Shakopee, MN (US); Billy Hunt, Onent, OH (US); Richard Wesen, Chisago City, MN (US); Joseph Novotny, New Prague, MN (US); Donald Hall, New Prague, MN (US)

(73) Assignee: Fabcon, Inc., Savage, MN (US)

( * ) Notice: Subject to any disclaimer, the term of this patent is extended or adjusted under 35 U.S.C. 154(b) by 0 days.

(21) Appl. No.: 10/391,081

(22) Filed: Mar. 17, 2003

(65) Prior Publication Data

US 2004/0088940 A1 May 13, 2004

Related U.S. Application Data

(63) Continuation-in-part of application No. 10/289,819, filed on Nov. 7, 2002.

(51) Int. Cl.[7] ..... E04C 5/08

(52) U.S. Cl. ..... 52/223.6; 52/583.1; 52/698; 52/309.4; 52/309.11; 52/220.2; 52/220.3

(58) Field of Search ..... 52/742.14, 223.6, 52/583, 698, 309.12, 511, 309.11, 220.3, 220.2

(56) References Cited

U.S. PATENT DOCUMENTS

| | | | | | |
|---|---|---|---|---|---|
| 1,755,457 | A | | 4/1930 | O'Hare | |
| 3,217,375 | A | | 11/1965 | Kinnard | 25/41 |
| 3,523,343 | A | | 8/1970 | Mitchell | 25/2 |
| 3,773,604 | A | * | 11/1973 | Desai et al. | 220/560.05 |
| 4,004,874 | A | | 1/1977 | Foster | 425/438 |
| 4,041,669 | A | | 8/1977 | Rauenhorst | 52/576 |
| 4,128,975 | A | * | 12/1978 | Abate | 52/125.4 |
| 4,141,946 | A | | 2/1979 | Rauenhorst | 264/69 |
| 4,234,634 | A | * | 11/1980 | Longinotti | 428/58 |
| 4,289,293 | A | | 9/1981 | Cashion | 249/74 |
| 4,398,761 | A | | 8/1983 | Hanson et al. | 294/81 R |
| 4,457,682 | A | | 7/1984 | Nash et al. | 425/219 |
| 4,628,653 | A | | 12/1986 | Nash | 52/309.12 |
| 4,712,349 | A | * | 12/1987 | Riley et al. | 52/408 |
| 5,398,470 | A | * | 3/1995 | Ritter et al. | 52/309.11 |
| 5,740,753 | A | * | 4/1998 | Theophanis | 114/267 |
| 6,066,222 | A | * | 5/2000 | Fulford | 156/154 |
| 6,298,622 | B1 | * | 10/2001 | Cretti | 52/309.7 |
| 6,457,288 | B2 | * | 10/2002 | Zambelli et al. | 52/220.2 |
| 6,460,213 | B1 | * | 10/2002 | Flint et al. | 14/73 |
| 6,609,340 | B2 | * | 8/2003 | Moore et al. | 52/309.11 |

* cited by examiner

*Primary Examiner*—Carl D. Friedman
*Assistant Examiner*—Nahid Amiri
(74) *Attorney, Agent, or Firm*—Vidas, Arrett & Steinkraus PA

(57) ABSTRACT

A method for casting hollow core concrete panels includes the use of raft connectors to hold a plurality of spaced foam billets in place during the manufacture to create panel or plank with spaced foam-filled cores. The panels include billets that form longitudinal voids that allows utilities to be run through the lengths of the concrete panels.

6 Claims, 8 Drawing Sheets

INSULATED CONCRETE CAST PANELS WITH VOIDS IN BILLITS

This application is a continuation-in-part of application Ser. No. 10/289,819 filed Nov. 7, 2002.

STATEMENT REGARDING FEDERALLY SPONSORED RESEARCH OR DEVELOPMENT

Not Applicable.

BACKGROUND OF THE INVENTION

This invention relates to a method for casting hollow core concrete panels in which the hollow cores are made by the use of foam billets held in place during the pours by using a raft connector. Extruders are eliminated via the invention herein. This represents the only hollow core concrete panel which may include cast in openings. This invention is an improvement over U.S. patent application Ser. No. 10/289,819 filed Nov. 7, 2002 by the same owner.

Previously, hollow core concrete panels have been formed by many methods, including single and multiple pass casting using moving beds and with stationary beds. The hollow cores are made by using slipform extruders that leave core material in place over which concrete is formed. Once cured, the panels are cut to length and lifted and tilted to remove the core material which may be reused.

Some hollow core panels have been made with an insulating layer across the entire surface, as shown in U.S. Pat. No. 4,628,653, the disclosure of which is incorporated herein by reference. Basically, a hollow core panel is cast and interlocking sheets of insulation are laid down before a final pour of concrete. This uniform layer of insulation increases the R-value of the finished wall panels and floor plank.

U.S. Pat. Nos. 4,041,669 and 4,141,946, the disclosures of which are incorporated herein by reference, describe a hollow-core concrete slab in which an inverted U-shaped foam piece is manually placed on a first layer of concrete that is ridged by a screed. The inverted U-shapes define a hollow void that remains after the second pour of concrete is made over the foam. Unfortunately, these early attempts proved to be unworkable and the problem of floatation of foam remained until this invention.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides all of the benefits of hollow core concrete panels with the advantages of insulating foam billets in the hollow core regions. This eliminates the need to use core material to form the hollow cores. In addition, extruders to extrude in the core material are no longer required. Since the extruders may be eliminated, it is also now possible with the invention to cast openings into the panels by placing forms to limit where the concrete flows. The use of core material necessitates additional handling difficulties, including lifting and tilting the panels to remove the core material, as best shown in U.S. Pat. No. 4,398,761, the disclosure of which is incorporated herein by reference. Even with the extra steps of forming lifting inserts, and having cranes to lift and tilt the panels, about a ton of core material is left in each panel, adding undesired weight and cost.

This improvement consists in using foam billets that form a hollow channel from end to end such that electrical conduit or other utilities may be readily run through the finished product without having to cut or otherwise form an opening through the length of the panel.

The generally rectangular-shaped foam billets are held together with raft connectors into a "raft" of foam billets. The unique raft connectors allows the foam billets to be connected together after each billet is placed on the bed. Alternatively, an entire raft of billets may be placed on the bed after being pre-assembled. The finished panel and plank is only "hollow core" in that cores of foam and defined open channels are formed throughout the panels and planks which provides insulation, requires far less concrete and eliminates a great deal of weight per panel or plank.

BRIEF DESCRIPTION OF THE DRAWINGS

A detailed description of the invention is hereafter described with specific reference being made to the drawings in which:

FIG. 11 is a perspective view of an end of a finished plank showing the billets that form an open channel for electrical conduit or the like;

DETAILED DESCRIPTION OF THE INVENTION

Figure 1:
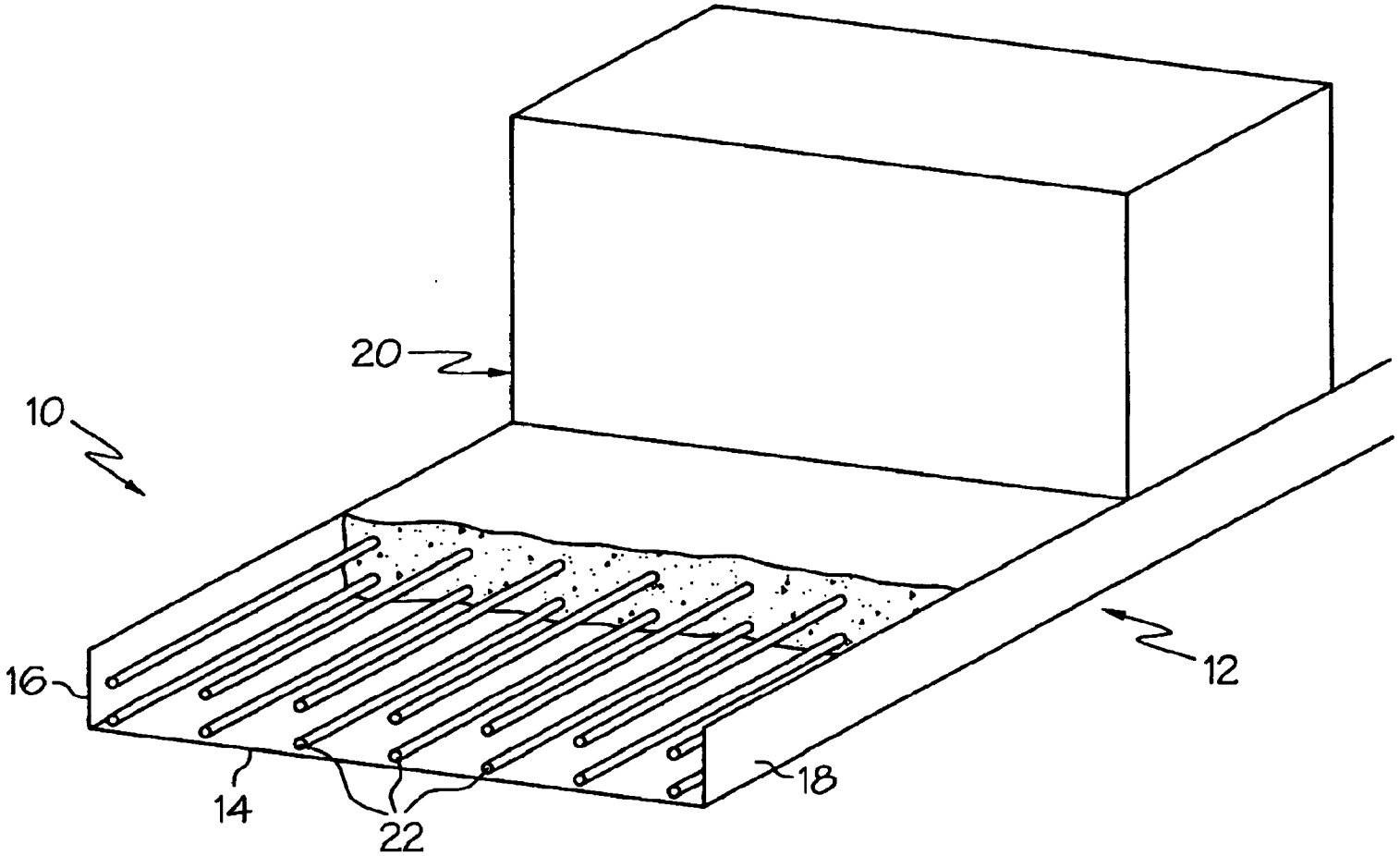
FIG. 1 is a perspective view of a typical apparatus for casting concrete panels.

With reference to the Figures, the inventive concrete slabs, panels or planks of the invention are formed with a standard concrete casting apparatus as shown in U.S. Pat. Nos. 3,217,375; 3,523,343; 4,004,874; 4,289,293 and 4,457,682, the disclosures of which are incorporated herein by reference. Basically, as shown in FIG. 1, such apparatus 10 includes a casting bed 12 that is either stationary or is driven along rails. The casting bed 12 has a bottom pallet 14 and side walls 16, 18. A concrete dispensing hopper 20 is shown in schematic form and can be of any of the current hoppers used to distribute concrete onto a moving bed. Alternatively, the hopper 20 may move relative to a stationary bed. Lower and upper prestressed cables, 22, 23, respectively, are positioned along the length of the bed 12.

Figure 2:
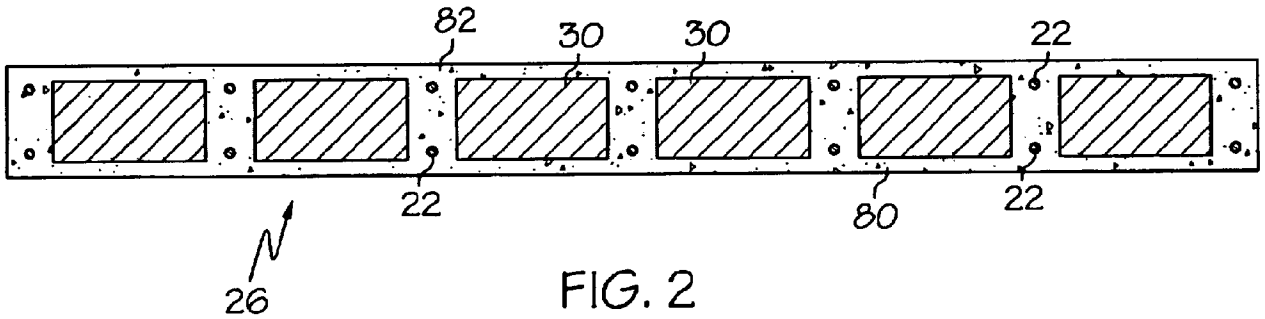
FIG. 2 is a cross-sectional view of a concrete panel of the invention.

FIG. 2 shows a cross-sectional view of a completed concrete panel 26 of the invention. The panel includes spaced foam billets 30 between each of the prestressed cables 22. When used herein, the term "foam billets" refers to billets of any material that become an integral member of the finished panel. Where "billets" is used herein, it refers to foam billets but also to any shape holding structure that may be placed in the bed to form a void for the hollow core panels to be formed. They could be formed from a corrugated cardboard product or any other material which would define the hollow core void as well. Although shown as generally rectangular in cross-section, the billets 30 may be shaped to require less concrete by being closer to each other while still avoiding the prestressed cables 22.

The raft connectors 36 of the invention tie into the foam billets 30 and the upper prestressed cable 23. Additionally, they may tie into any lateral rebar that is placed on top of the foam billets secured together by the raft connectors 36.

Figure 3:
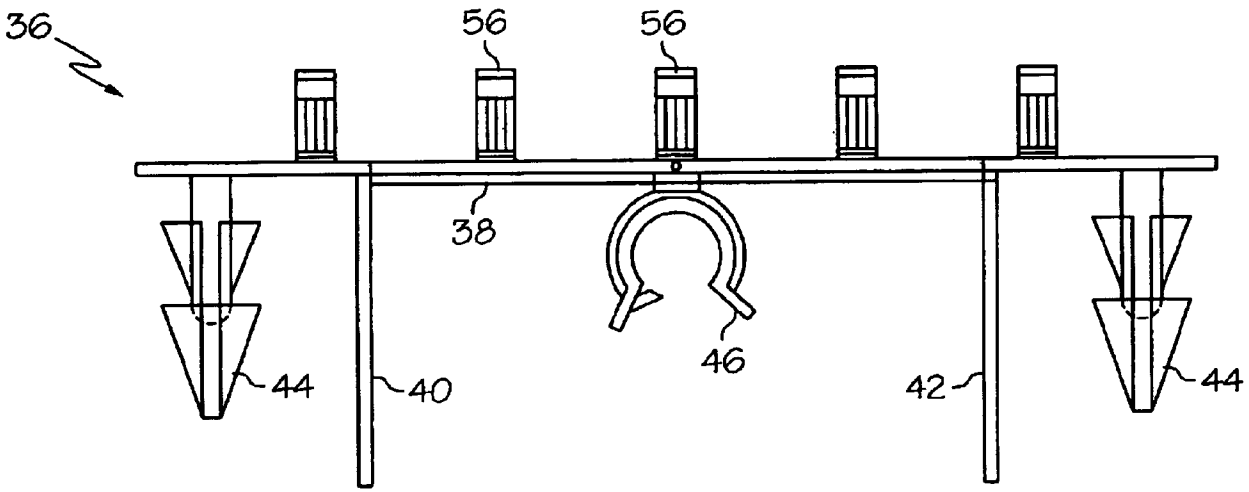
FIG. 3 is an end view of a raft connector of the invention.
Figure 4:
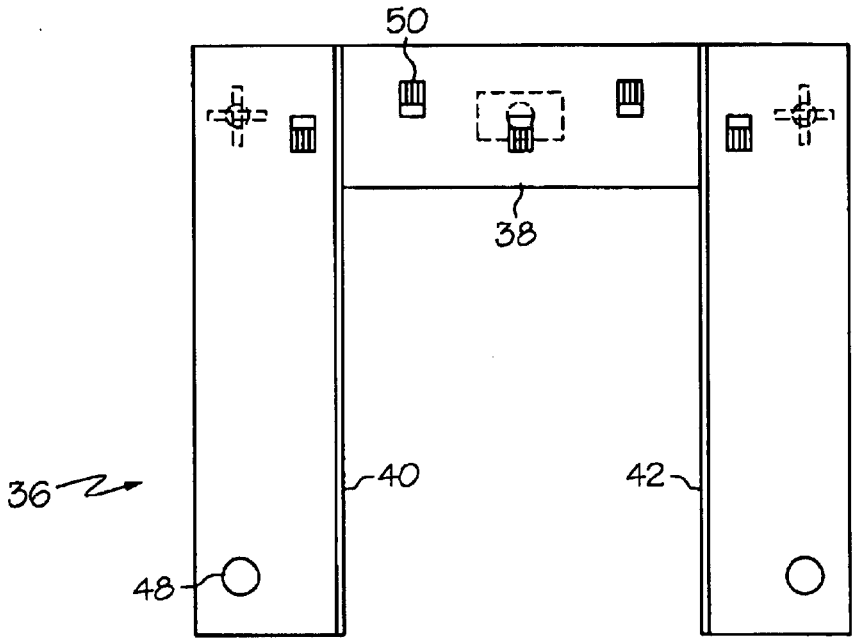
FIG. 4 is a top view of the raft connector of the invention of FIG. 3.
Figure 5:
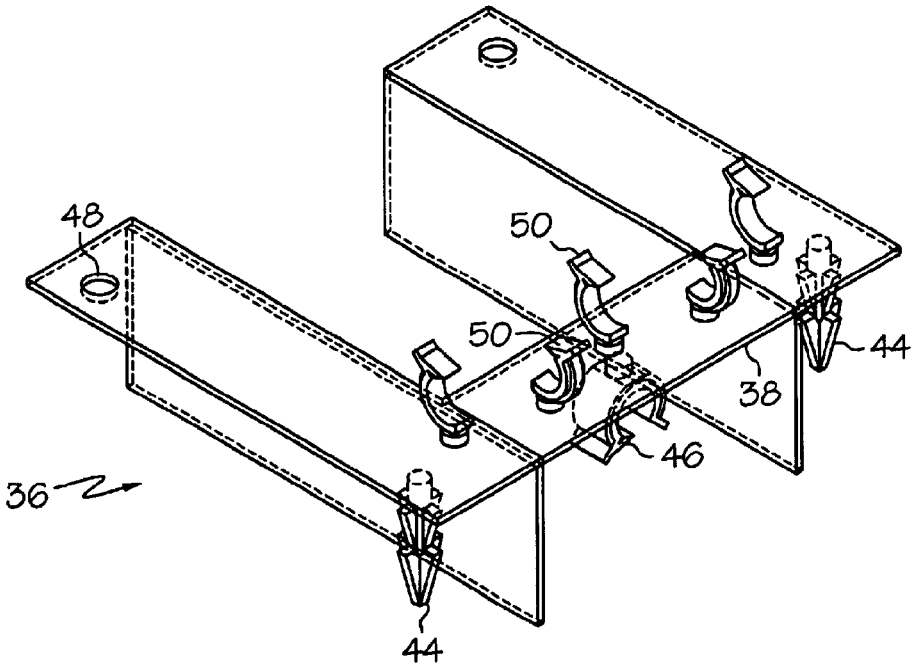
FIG. 5 is a perspective view of the raft connector of the invention of FIGS. 3 and 4.

The raft connectors 36 as shown in FIGS. 3–5 may be molded of plastic and may include for each billet 30, a pair of spaced L-shaped brackets 40, 42 of plastic held together in the spaced relation by a cross-bar 36. The L-shaped brackets 40, 42 function to hold adjacent end to end billets together. An opening 48 may be provided through a remote end as shown to allow attachment of the raft connector to a second billet that is end to end with the billet that the cross-bar 38 crosses. The billets 30 may have ends that are formed to interlock together as well. The cross-bar 36 may include downwardly projecting spikes 44 that cut into the foam billets 30 and hold the raft connectors 36 to the foam billets 30. A prestressed cable connector 46 may also be formed in the raft connector to simply snap onto the prestressed cable. In addition, the raft connector may have half-clips 50 spaced along the top to which lateral rebar may be attached, if desired.

Figure 7:
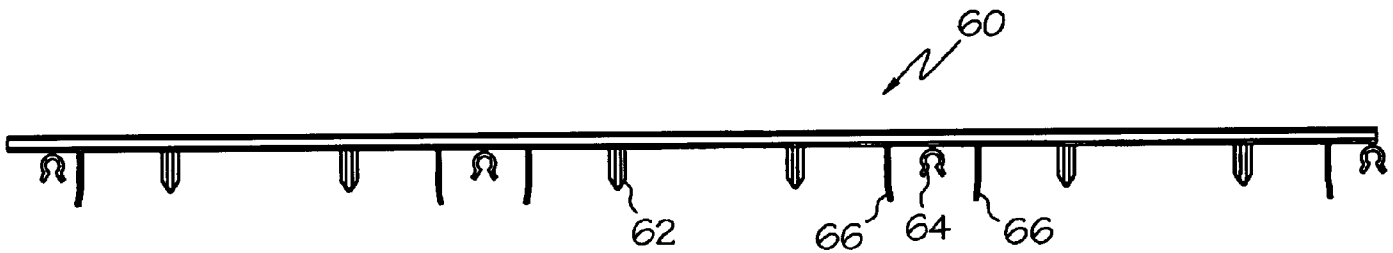
FIG. 7 is an alternative raft connector of the invention.

The raft connectors 36 may be a single piece to cover the entire width of the bed or may be formed in sections that can be attached to form widths that cover the bed, to fit any bed width. FIG. 7 shows an alternative raft connector 60 which is a single piece the width of the casting bed 12 that includes spikes 62 to press into the billets 30, prestressed cable connectors 64 to attach to the prestressed cable 23 and side guides 66 that fit on either side of each billet 30. If lateral rebar is desired on top of the billets, the raft connector of FIG. 7 may have half-clips on its top as in the raft connector 36.

Figure 8:
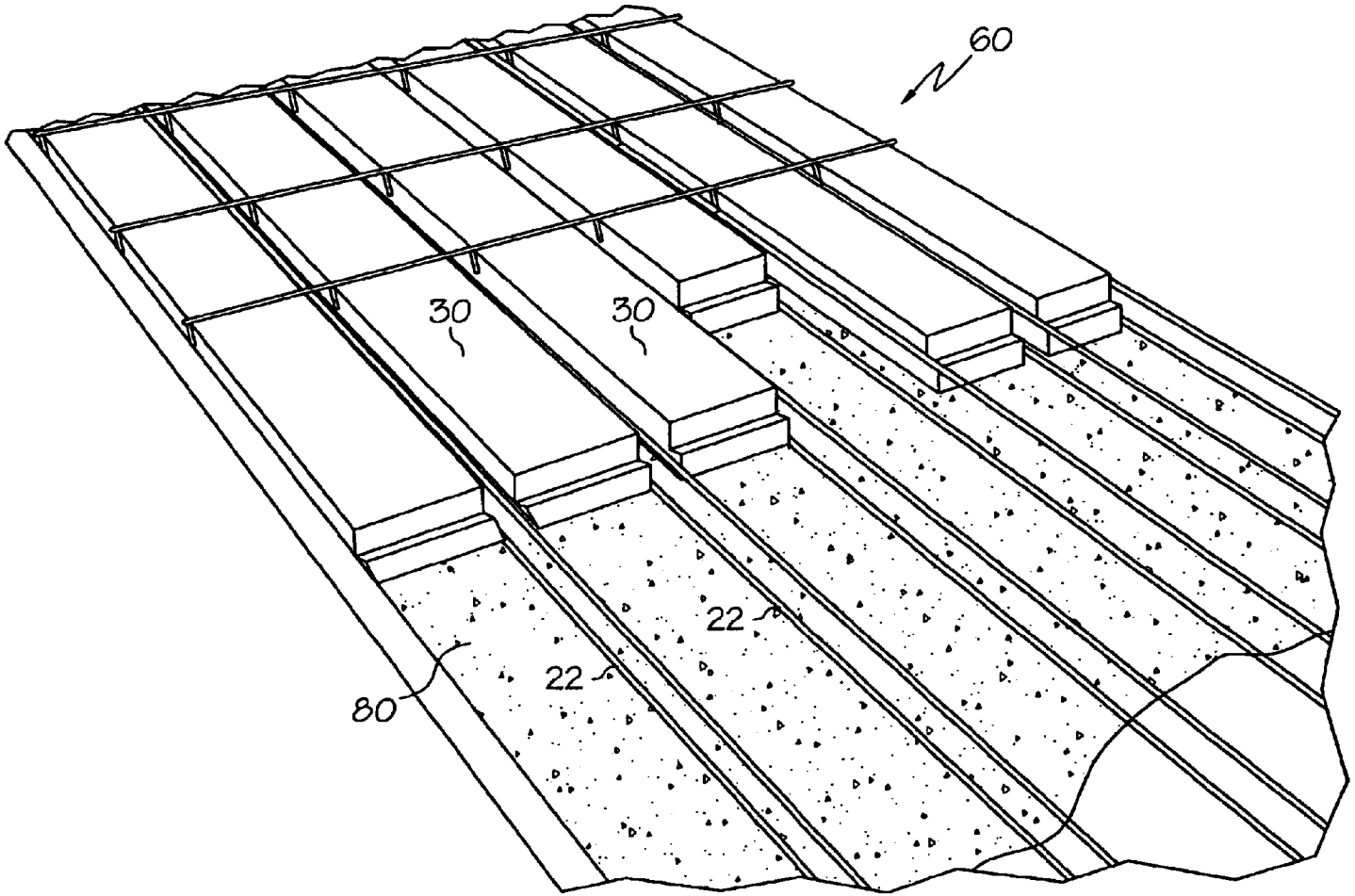
FIG. 8 is a perspective view of a casting bed with foam billets in place in an alternative raft connector.

Alternatively, as shown in FIG. 8, the raft connectors 36 may be formed from a rebar 70 that has downwardly descending studs 72 welded or otherwise affixed thereto at spaced intervals such that a stud 72 is on each side of a foam billet 30 and the rebar crosses the top of the billet. The foam billets 30 may be bonded better to the top layer of concrete by piercing the foam billet with pins that pierce the foam and have projections above the foam layer that are buried in the upper layer of concrete. Wire ties may be added to the raft connectors to tie the raft connectors to the prestressed cable 23.

Figure 9:
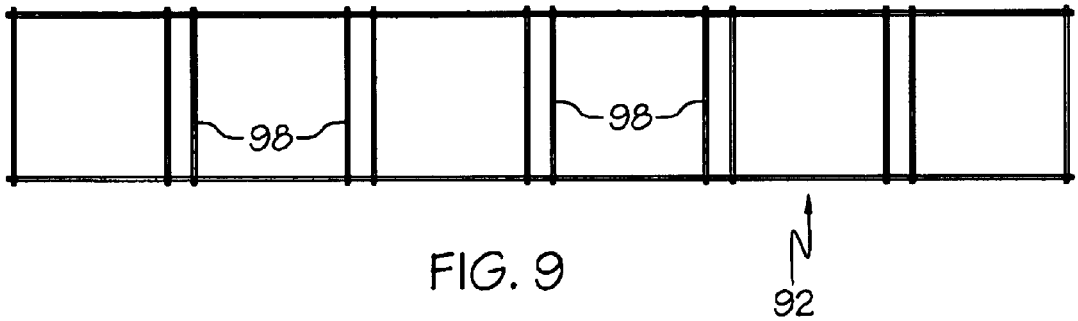
FIG. 9 is a top view of a mesh lattice used with a u-shaped bracket as an alternative raft connector.
Figure 10:
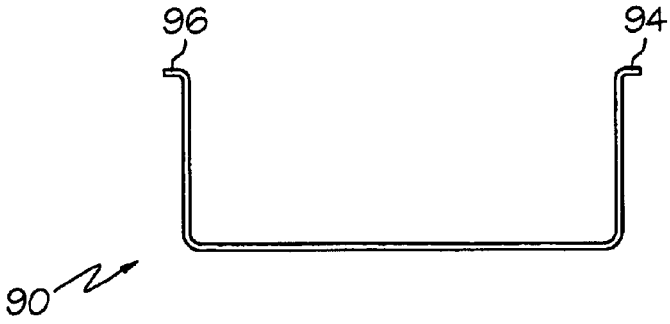
FIG. 10 is a front elevational view of the u-shaped bracket.

Another alternative raft connector is shown in FIGS. 9 and 10. Those figures show a u-shaped bracket 90 which is positioned underneath each foam billet 30. A top mesh lattice 92 extending across the width of the bed 12 is placed above the billet and secured to the prestressed cable 23 with wire ties or the like. The u-shaped member 90 may be placed from above through the mesh lattice 92 until its end tabs 94, 96 contact crossbars 98 of the mesh lattice 92. After so positioning, the foam billets 30 may be slid into the opening defined by the u-shaped brackets 90 and the mesh lattice 92, securely holding the foam billets from movement in all but the longitudinal direction.

Figure 11:
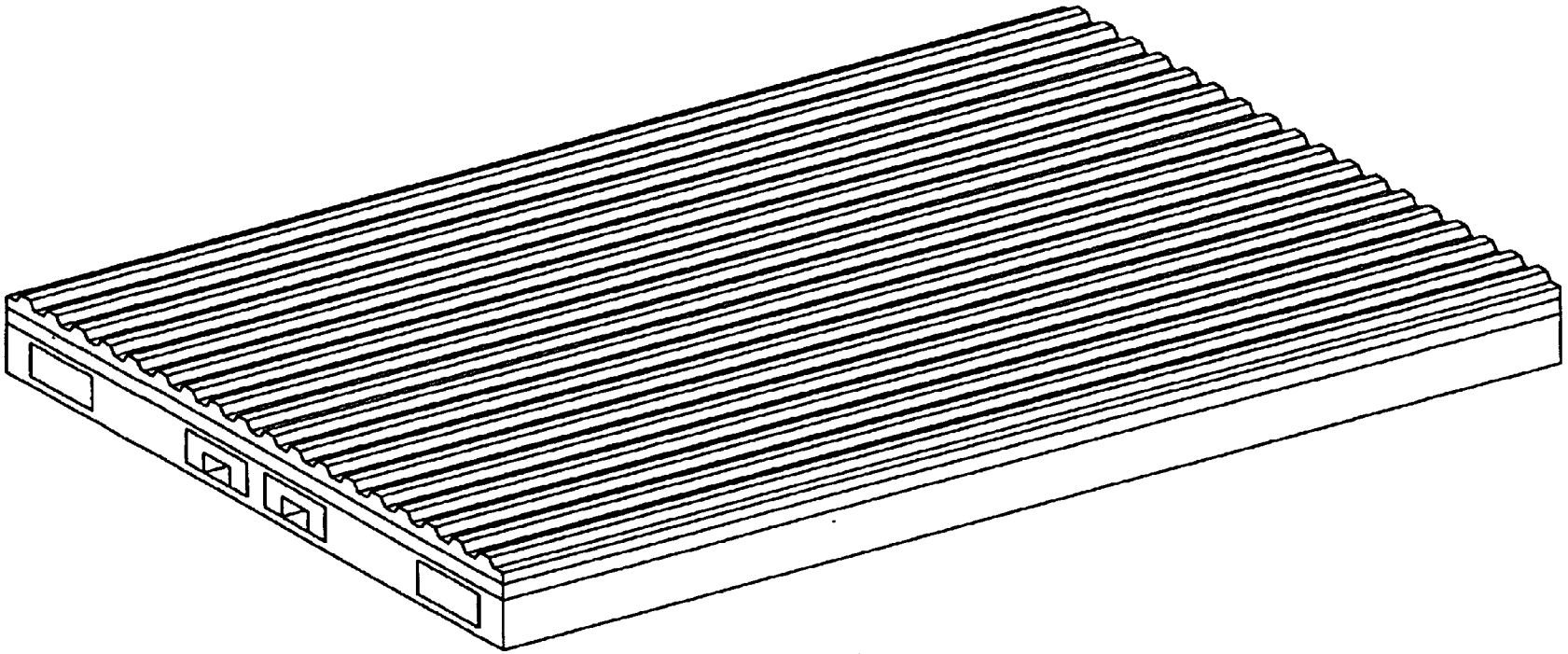
Figure 12:
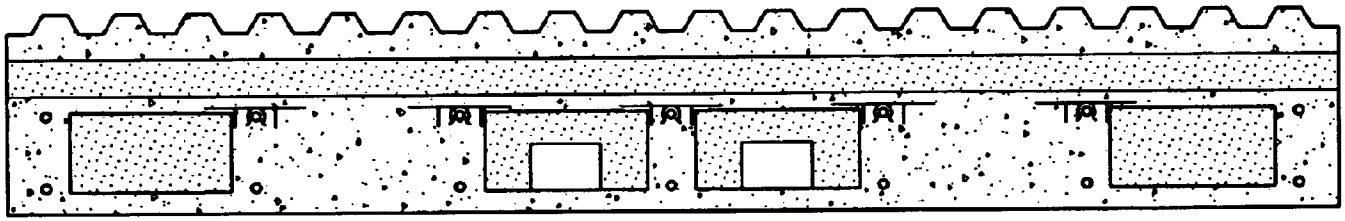
FIG. 12 is an end view of a finished panel with foam billets that have three sides forming an arch which defines an open channel when used in accordance with the invention.
Figure 13:
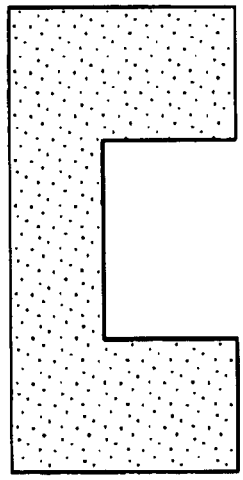
FIG. 13 is an end view of a foam billet of the invention suitable for forming a longitudinal open channel.

FIGS. 11 through 13 show an improved billet 90 which may have all of the characteristics of the billets 30 except that they are formed to define a void that is open through the length of the billet 90 such that an opening 92 is present in the finished panels 26 through which electrical conduits or other services may be readily placed without the need to force an opening through the billets. As shown, the billet 90 has a top 94 and legs 96, 98 which define an arch and together with the methods of the invention forms the opening 92 with the bottom concrete layer 80. Although shown with an arch shape, the billets 90 of the invention may have a bottom or may be solid foam billets with conduit running through the foam to form the opening 92. In addition, multiple legs may be used to form more than one discrete opening 92 if desired. FIG. 12 shows two of the billets 90 and two billets 30; however, any combination of billets may be made including all of one type.

Although shown in the figures with only some of the billets having the defined void, all of the billets in a finished panel may have the voids. The figures show that a combination may be employed. In addition, it must be noted that the billets may be made of material other than foam and need not be generally rectangular shaped, nor must the void define a rectangular shape. The opening 92 may be of almost any form depending only on the services that will be run through the panel. If desired, the openings 92 may be run through less than the entire length of the finished panel simply by placing closed billet sections in position in line with the billets with openings 92. Access to these openings would then need to be made through the sides of the finished panel.

The billets 30 are shown made from discrete sections of foam that are placed end to end. Of course, the billets may also be provided from a continuous length billet if the billet is formed on site with a forming machine, in which case no discrete billet lengths are required.

The billets 90 make it much easier to run services through the concrete panels of the invention. With billets 30 of solid foam, a channel must be formed through the billets where desired. With the present invention, the channels are already in place for electrical conduit or any other utility to be run. The channels may be reached by cutting through the bottom or top of the concrete panel or from the open ends.

Figure 6:
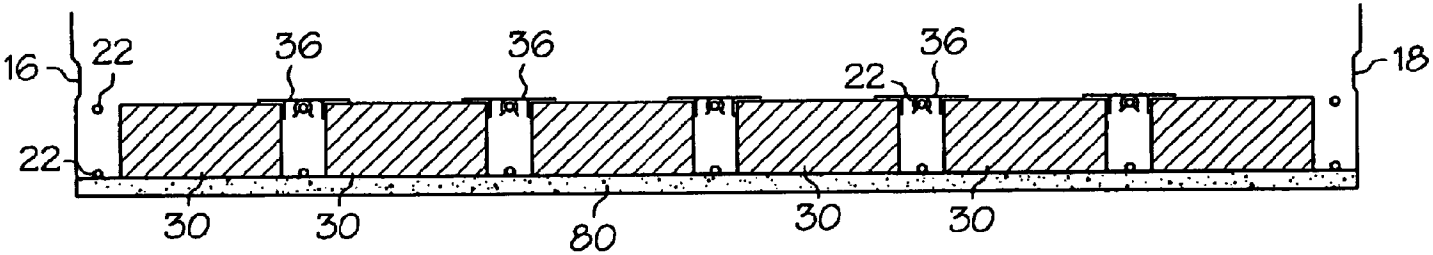
FIG. 6 is a cross-sectional view of a casting bed with foam billets, connectors and a lower concrete layer cast.

In operation, as, shown in FIG. 6, a first layer of concrete 80 is cast with a very fluid mix called "self-compacting concrete" in the industry. This concrete does not require a screed step. The rafts of billets 30 are either then made by connecting billets to the raft connectors 36 on the bed 12 or partially assembled rafts are simply laid on top of the first layer and are attached to the prestressed cables 23. Any lateral rebar is then attached to the raft connectors. Finally, the top layer of concrete 82 is cast which is a traditional concrete mix. Any insulating sheets are placed on top of the structural section.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention.

What is claimed is:

1. A hollow core concrete panel comprising:

a) a lower layer of concrete;

b) a plurality of interconnected, spaced billets above said lower layer of concrete, at least one of said billets having at least one opening through the length of said billets, said billets being held in place by a plurality of raft connectors which are in turn secured to a prestressed cable within said hollow core panel; and c) an upper layer of concrete surrounding said interconnected billets and being bonded to said lower layer of concrete.

2. A hollow core concrete panel comprising:

a) a lower layer of concrete;

b) a plurality of prestressed cables extending the length of said panel;

c) a plurality of interconnected, spaced billets above said lower layer of concrete, at least one of said billets having at least one opening through its length; and d) an upper layer of concrete surrounding said interconnected billets and being bonded to said lower layer of concrete.

3. The hollow core concrete panel of claim 2 wherein said billets are formed of extruded foam.

4. A hollow core concrete panel comprising:

a) a lower layer of concrete;

b) a plurality of interconnected, spaced billets above said lower layer of concrete, at least one of said billets define a longitudinal open channel through the length of said panel, said billets being held in place by a plurality of raft connectors which are in turn secured to a prestressed cable within said hollow core panel; and c) an upper layer of concrete surrounding said interconnected billets and being bonded to said lower layer of concrete.

5. The hollow core concrete panel of claim 4 wherein said billets are formed of extruded foam extruded into an arch shaped channel.

6. The hollow core panel of claim 5 wherein said arch-shaped channel includes a top and a pair of descending legs.

* * * * *